US012110686B1

(12) United States Patent
Kocsis

(10) Patent No.: US 12,110,686 B1
(45) Date of Patent: Oct. 8, 2024

(54) BUILDING ELEMENT FOR A PREFABRICATED, MODULAR, SEMI-PERMANENT AND RELOCATABLE STRUCTURE

(71) Applicant: AGAM Group, Ltd., Elkridge, MD (US)

(72) Inventor: Tamas Kocsis, Ellicott City, MD (US)

(73) Assignee: AGAM Group, Ltd., Ellicott City, MD (US)

( * ) Notice: Subject to any disclaimer, the term of this patent is extended or adjusted under 35 U.S.C. 154(b) by 0 days.

(21) Appl. No.: 18/652,074

(22) Filed: May 1, 2024

Related U.S. Application Data

(60) Provisional application No. 63/463,173, filed on May 1, 2023.

(51) Int. Cl.
*E04C 2/38* (2006.01)
*E04B 2/00* (2006.01)

(52) U.S. Cl.
CPC ..... *E04C 2/384* (2013.01); *E04C 2/46* (2013.01)

(58) Field of Classification Search
None
See application file for complete search history.

(56) References Cited

U.S. PATENT DOCUMENTS 2,049,925 A * 8/1936 Rafter ..... E04C 2/384 52/657
2,862,257 A * 12/1958 Comer ..... E06B 3/72 49/501
3,014,561 A * 12/1961 Ratner ..... E04B 1/6175 52/581
3,634,987 A * 1/1972 Huguet ..... E04C 2/384 52/656.1
3,700,385 A * 10/1972 Sherwood ..... E04B 2/7422 160/135
3,828,516 A * 8/1974 Kern ..... E06B 3/98 52/656.9
4,485,597 A * 12/1984 Worrallo ..... F16B 7/0473 403/255
4,556,337 A * 12/1985 Marshall ..... F16B 7/0473 403/255
4,924,649 A * 5/1990 Taylor ..... E04C 2/546 403/402
5,005,333 A * 4/1991 Ott ..... E06B 3/5828 52/766

(Continued)

*Primary Examiner* — Joshua K Ihezie
(74) *Attorney, Agent, or Firm* — Larry J. Guffey, Esq.; Oliver & Grimsley, LLC

(57) ABSTRACT

A building element for a semi-permanent and relocatable structure includes: (a) a member having a rectangular, cross-sectional shape, that encloses an interior portion which has open ends that include cornering portions, (b) a pair of flanges, one of which extends outwardly from each of the member's top corners, (c) a pair of member cavities, each extending between the member's open ends and being located proximate an interior, bottom corner and having an opening that provides access to the cavity, (d) a 90-degree, mitered bracket, with fasteners, configured to fit into the open end of a member cavities and join two members on their ends at a right angle, and (e) a detent formed in each of cavity and configured to provide a locking mechanism for the free end of the fastener.

20 Claims, 6 Drawing Sheets

(56) References Cited

U.S. PATENT DOCUMENTS

| | | | | |
|---|---|---|---|---|
| 5,737,893 | A * | 4/1998 | Rossiter | E04B 2/7425 160/381 |
| 5,918,392 | A * | 7/1999 | Bates | B44D 3/185 160/381 |
| 6,014,842 | A * | 1/2000 | Matsubara | E04C 2/384 52/234 |
| 6,397,551 | B1 * | 6/2002 | Lewcock | E04B 2/766 403/255 |
| 7,971,622 | B2 | 7/2011 | Trionfetti | |
| 8,857,496 | B2 | 10/2014 | Raniere | |
| 9,840,841 | B2 * | 12/2017 | Gosling | E04B 2/7457 |
| 2001/0014250 | A1 * | 8/2001 | Plummer | B29C 66/1162 403/295 |
| 2004/0231283 | A1 * | 11/2004 | LaSusa | B29C 53/066 156/73.6 |
| 2009/0217612 | A1 * | 9/2009 | Window | E04B 5/04 52/414 |
| 2014/0075851 | A1 | 3/2014 | Rhines et al. | |
| 2014/0115985 | A1 | 5/2014 | Hayashi | |

* cited by examiner

BUILDING ELEMENT FOR A PREFABRICATED, MODULAR, SEMI-PERMANENT AND RELOCATABLE STRUCTURE

CROSS-REFERENCE TO RELATED APPLICATION

This application claims the benefit of Provisional Patent Application No. 63/463,173, filed May 1, 2023 by the present inventor. The teachings of this application are incorporated herein by reference to the extent that they do not conflict with the teaching herein.

BACKGROUND OF THE INVENTION

1. Field of the Invention

The present invention generally relates to building construction and the structural framework systems for prefabricated, modular, semi-permanent and relocatable structures. Examples of such might include interior offices, conference rooms, work areas, consultation rooms, retail environments and display structures.

2. Description of the Related Art

There exist many framework systems for prefabricated, semi-permanent and relocatable structures. Examples of these systems are provided in U.S. Pat. Nos. 6,397,551, 7,971,622, and 8,857,496, and U.S. Patent Publications Nos. 2014/0075851, and 2014/0115985.

Usually, these systems are made from light-weight materials and designed for easy mounting and removal, fast assembly, and full reusability. However, because of the ever-changing, and novel design requirements of such structures, there is a continuing need to improve upon the building elements and technology used in them.

It is an object of the present invention to provide an improved building element for use in semi-permanent and relocatable structures. The building element of the present invention seeks to enhance the configurability and adaptability of such structures, thereby making them more customizable while still allowing them to be built fast and reliably.

DESCRIPTION OF THE PREFERRED EMBODIMENT

Figure 1:
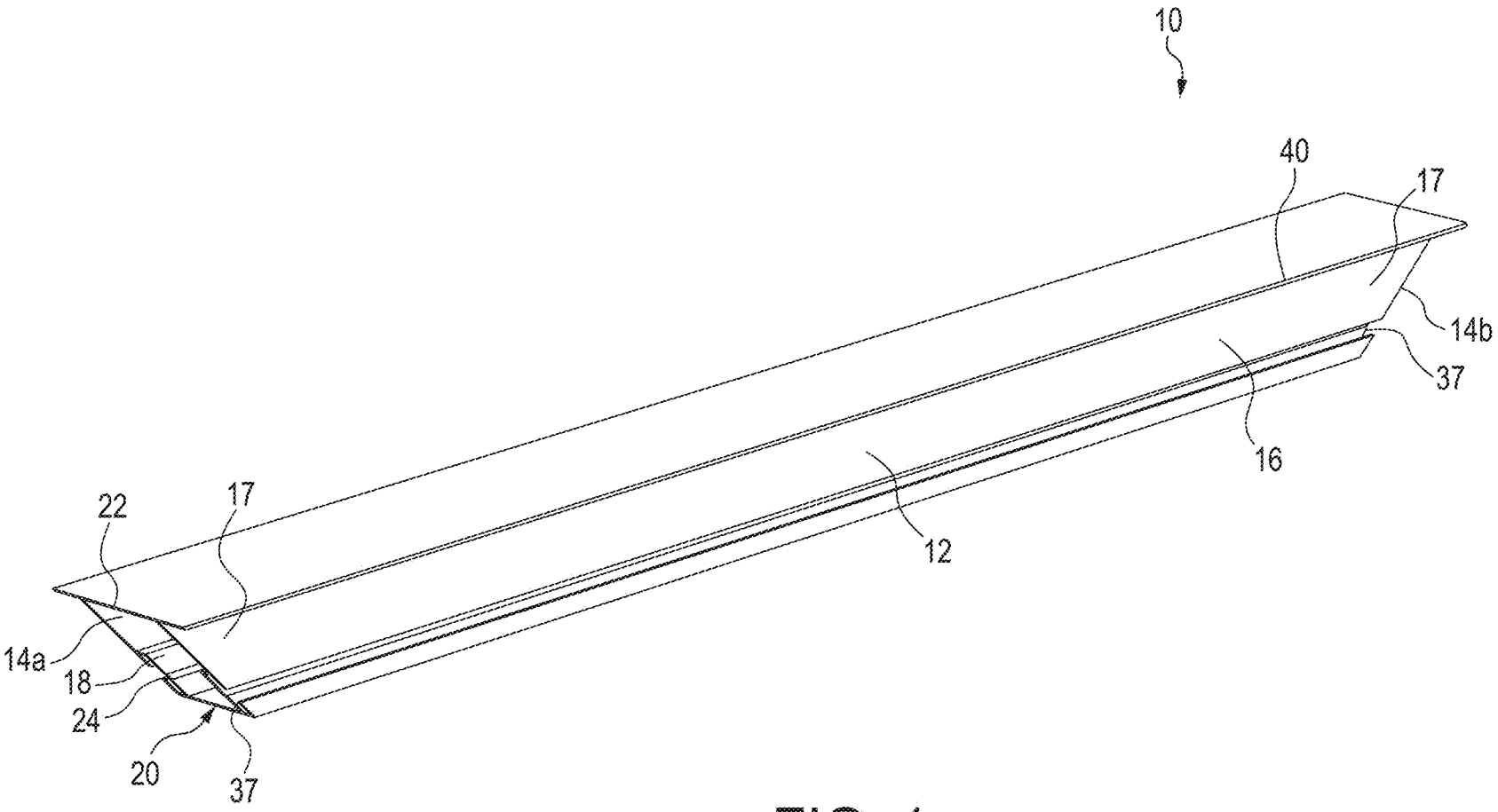
FIG. 1 shows a top perspective view of an example of the present invention in the form of the member part of a building element that has been cut to a specified length.

Recognizing the need for continued improvements to the building elements used in the structural framework systems for semi-permanent and relocatable structures, the present invention seeks to provide such an improved building element.

Various aspects, advantages, features and embodiments are included in the following description of exemplary examples thereof, which description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a top perspective view of an example of the present invention in the form of the member part of a building element 10. The present invention is seen to be an aluminum extruded beam or member 12 that has a generally rectangularly-shaped cross-section and is designed to be made to a needed length and joined with other such members to form a rectangular frame of a desired size to create a temporary wall, or room, etc.

Figure 2:
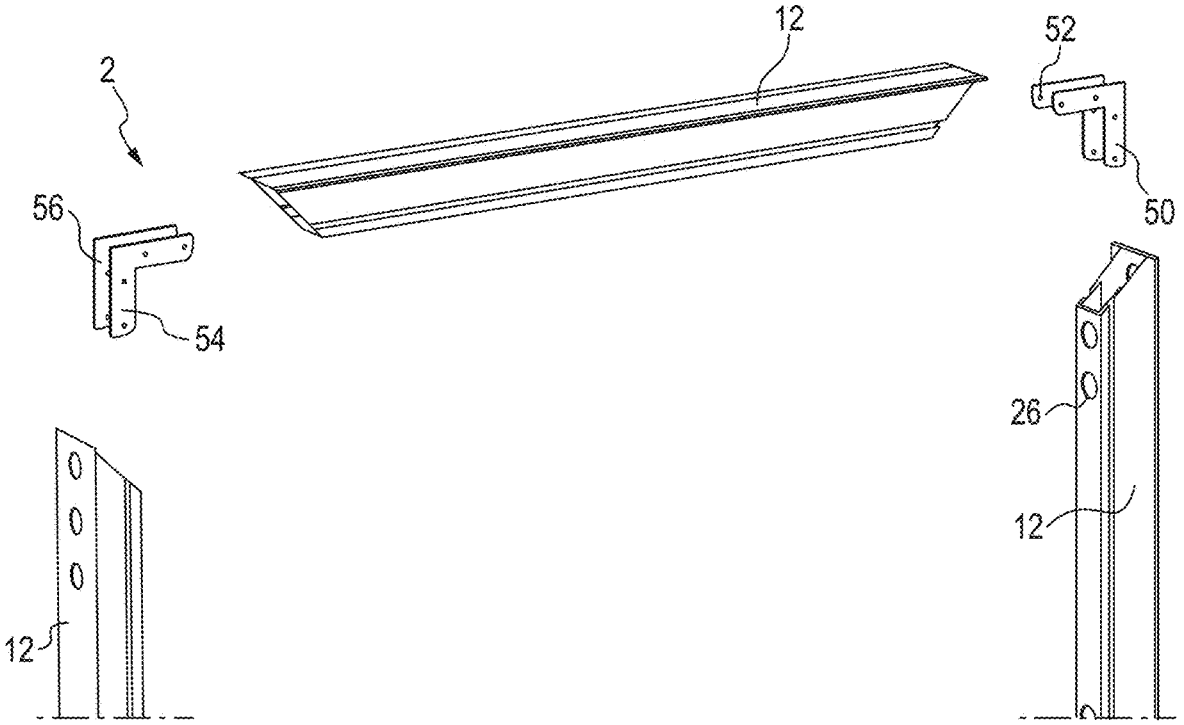
FIG. 2 shows a perspective view of the top portion of a rectangular frame that is about to be assembled by connecting, at their ends, three, various length pieces of the member shown in FIG. 1 and by using four, 90-degree, mitered brackets to connect the ends shown.
Figure 3:
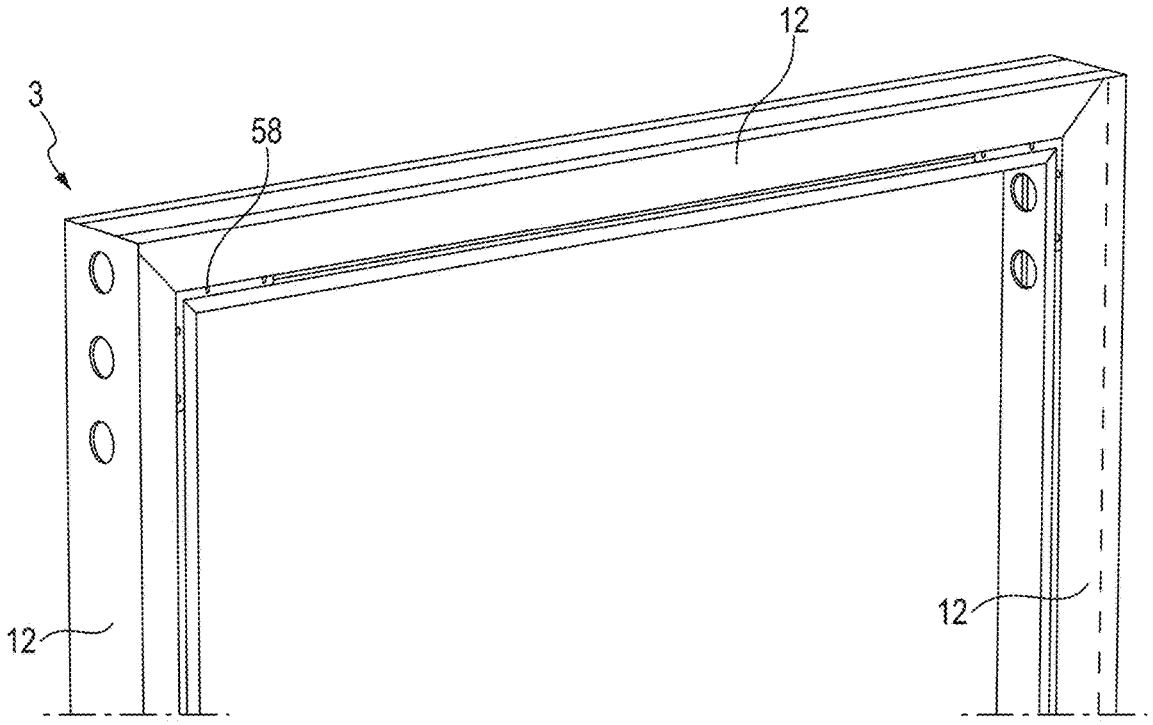
FIG. 3 shows a perspective view of the top portion of the rectangular frame shown in FIG. 2 after the frames have been connected.

Examples of a portion of such a being-assembled, rectangular frame 2, and a portion of an assembled, rectangular 3 are shown in FIGS. 2 and 3, respectively. These frames are seen to be assembled by connecting various of these cut-to-length members on their ends 14 and at right angles. To accommodate this, the sides 16 of these members in the regions proximate their ends, which are open and reveal an interior portion 18 of this member, have a cornering portion 17 that has been cut or tapered to a 45-degree angle from the point where the bottom 20 of these members temporarily attach or connect and upward to the top 22 of the member. The centerline 24 of these members are brought together they form a 90-degree angled, mitered joint at each member's open end.

Two 90-degree, mitered brackets 50 are used to temporarily attach the members' ends. These brackets consist of two, similarly shaped legs 52 that join at right angles at the bracket's center. Each of these legs has a cross-section which is rectangular in shape, thereby providing each leg of the bracket with two exterior surfaces 54 and a characteristic height, width and cross-sectional area. Holes 56 between these exterior surfaces are provided to aid in locking these brackets to a member.

Figure 4:
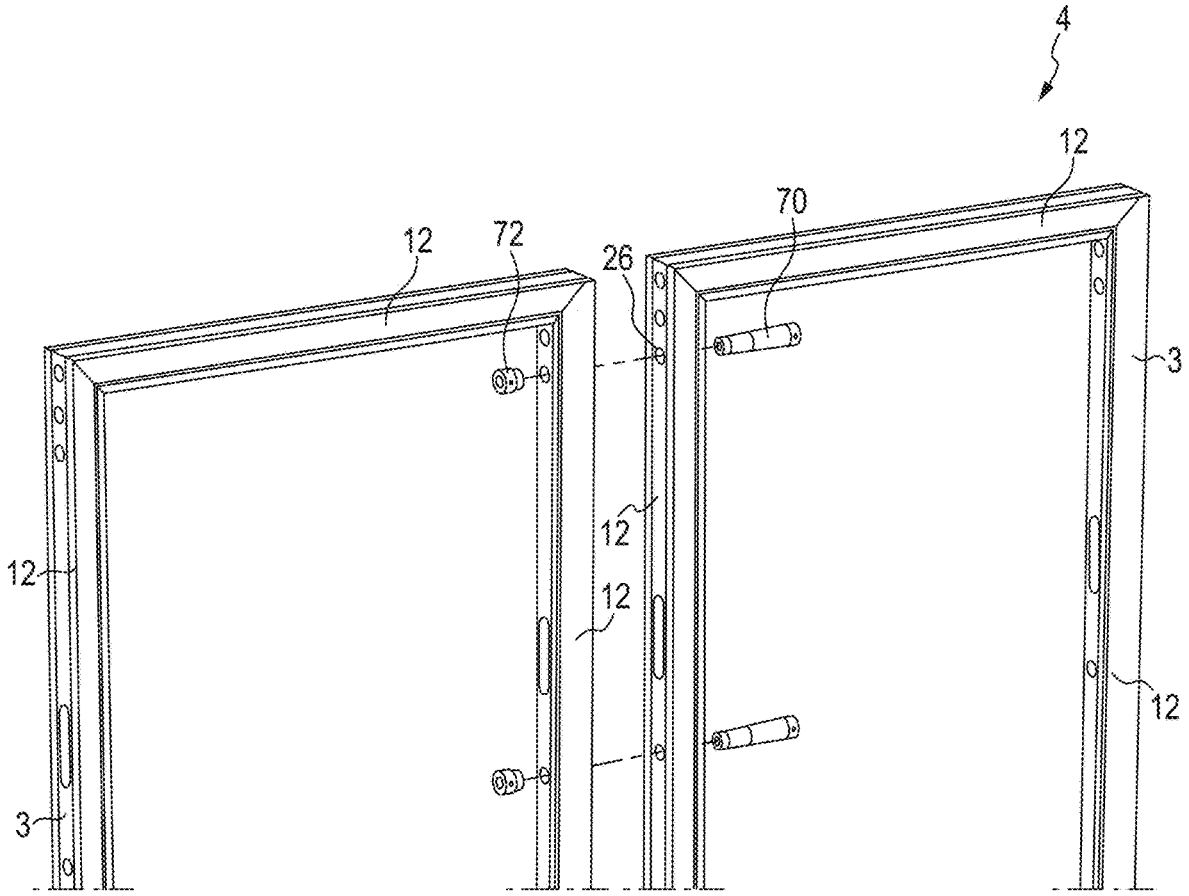
FIG. 4 shows a perspective view of the top portion of the beginnings of a wall that is about to be assembled by connecting, along their sides, two of the rectangular frames that were shown in FIG. 2 and then using tube connectors and nuts to make these connections.

A portion of a being-assembled, wall 4 using such assembled, rectangular frames 3 is shown in FIG. 4. Tube connectors 70 and their nuts 72 are seen to be used to join the sides of these rectangular frames by utilizing the connector holes 26 in the members that run from their top to their bottom. These connectors are designed to enable the structures of the present invention to be quickly assembled with few, if any, tools.

Figure 5:
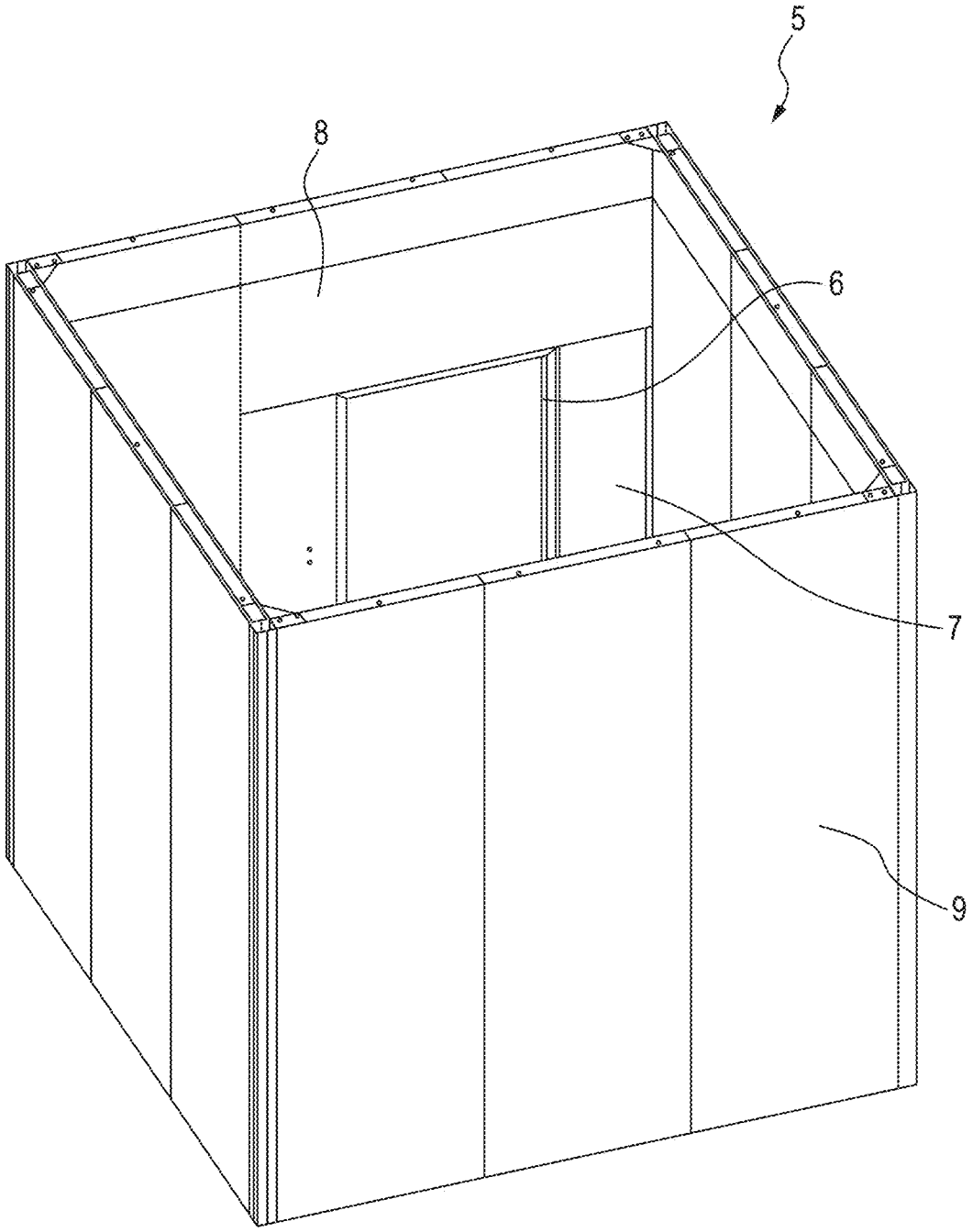
FIG. 5 is an example of a room that has been constructed by utilizing various, cut-to-length versions of the members shown in FIG. 1, including a uniquely-sized, door frame, door side panels and a door header.

FIG. 5 shows an example of a room 5 that has been constructed by utilizing various, cut-to-length versions of the members shown in FIG. 1, including a door frame 6, door side panels 7 and a door header 8. Note that the areas or confined spaces enclosed by the room's rectangular frames have, in this instance, been filled with an insulating material and a covering in the form of a wall surface/panel 9 that is temporarily attached to the member's sides to insulate the walls and create their interior and exterior surfaces. In other instances, the areas enclosed by one or more of a room's rectangular frames might be covered with a transparent membrane to form a window for the room.

Figure 6:
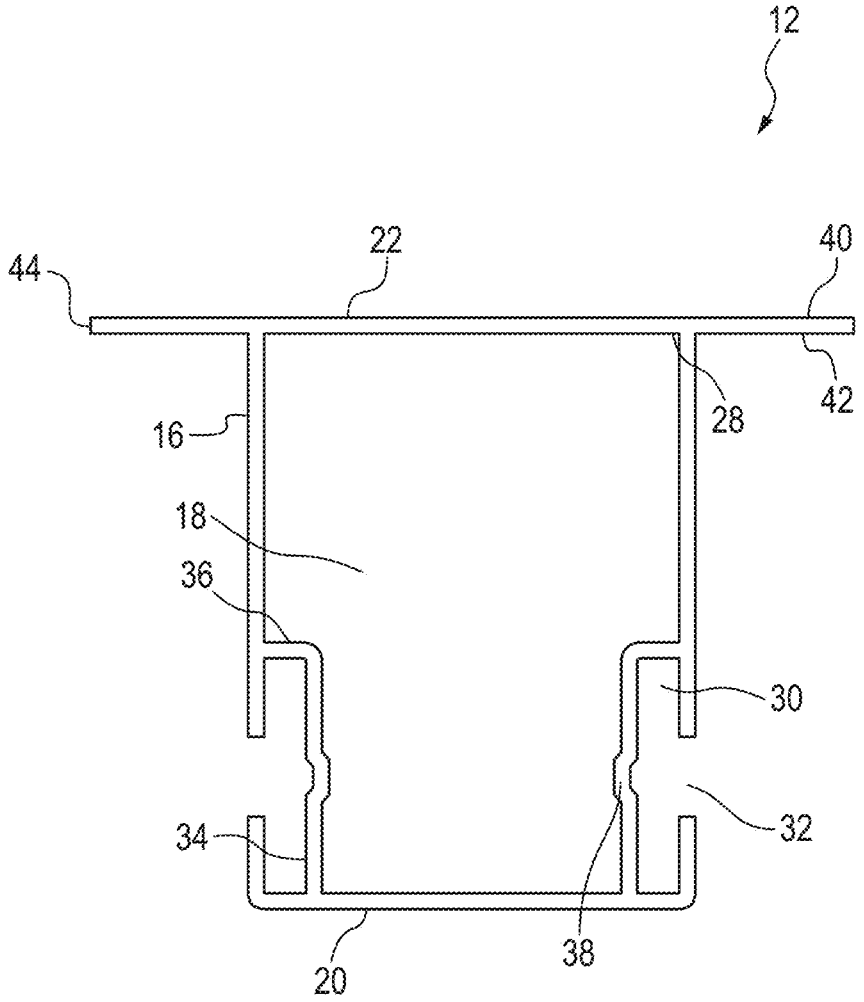
FIG. 6 shows an end, cross-sectional view of the member shown in FIG. 1.

FIG. 6 shows an end, cross-sectional view of the member shown in FIG. 1, and with the shape shown in this view being uniform as one moves from a proximal end 14*a* to a distal end 14*b* of the member 12. As previously noted, this member has a generally rectangular, cross-sectional shape that includes an interior portion 18 that has a top 22, a bottom 20, and two sides 16, each of which has a flat exterior surface. The flatness of the exterior surfaces of these sides proves useful when applying a facing or frame/wall surface or panel 9 to the rectangular frames 3 that are assembled using these members.

The member's interior portion has four corners 28 that are formed by the intersection of its sides with its top and bottom. It also has a pair of cavities 30, with each being located so as to enclose one of the interior portion's bottom corners. At a member's open ends, these cavities also have access points which we identify as cavity end entries 37. Access from the side of a member to each of these cavities is provided by having a cavity opening 32 in each side that runs parallel to the member's centerline and from one end to the other end of the member. Each of these cavities includes a cavity side 34 and a cavity top 36 (which taken together form a cavity sidewall) and wherein the cavity top is attached to the member's side and the cavity side is attached to a member's bottom. Note also that the cavity side has a detent 38 which is configured to help hold the free end of a screw or fastener 58 that is used in assisting this cavity perform its intended task of helping to connect two members together at their ends.

The cross-sectional shape and enclosed area of each of these cavities is configured to aid the members in being connected to each other at right angles and at their open ends 14. This is accomplished by making a cavity's cross-sectional shape so that it allows a leg 52 of the 90-degree, mitered bracket 50, when it is moved in a direction parallel to a member's centerline 24, to slide from a member's open end and into the member's cavity 30. When a bracket's leg is fully inserted into a cavity, the free end of a fastener 58 is passed through a bracket's hole 56 and secured into the detent 38 that exists in the cavity's side 34.

A flat flange or ledge 40 extends outwardly from each of the member's top two corners and is oriented in a direction that aligns with the member's top 22. Each of these flanges has a flat, upper and lower boundary surface 42 that is parallel to the top and extends out to a distal tip 44. The location of this distal tip from the member top corner, that attaches to the flange 40 whose free end is this distal tip 44, defines the length of this flange 40. The length of this flange is important because it determines to a significant degree the types of coverings or wall surface/panel 9 that can be used with rectangular frames that are formed by joining the building elements of the present invention. In order to allow for a wide variety of coverings to be used with these rectangular frames, these flange lengths are typically in the range of ⅜ of an inch to 1" inch, and preferably approximately 11/16 of an inch. Meanwhile, the typical heights and widths of a member's rectangular cross-section are in the ranges of 2 to 3 inches and 1 to 2 inches, respectively.

As previously mentioned, the present invention, in terms of its use in structural framework systems for semi-permanent and relocatable structures, has also been engineered and designed for use in office, retail, and health care environments. These environments differ from showrooms in that they have a requirement for sound privacy. Thus, the flanges of the present invention have been configured so that they can hold sufficient thickness, sound insulating materials. For example, the flanges of the present invention can hold rigid materials 80.

Figure 7:
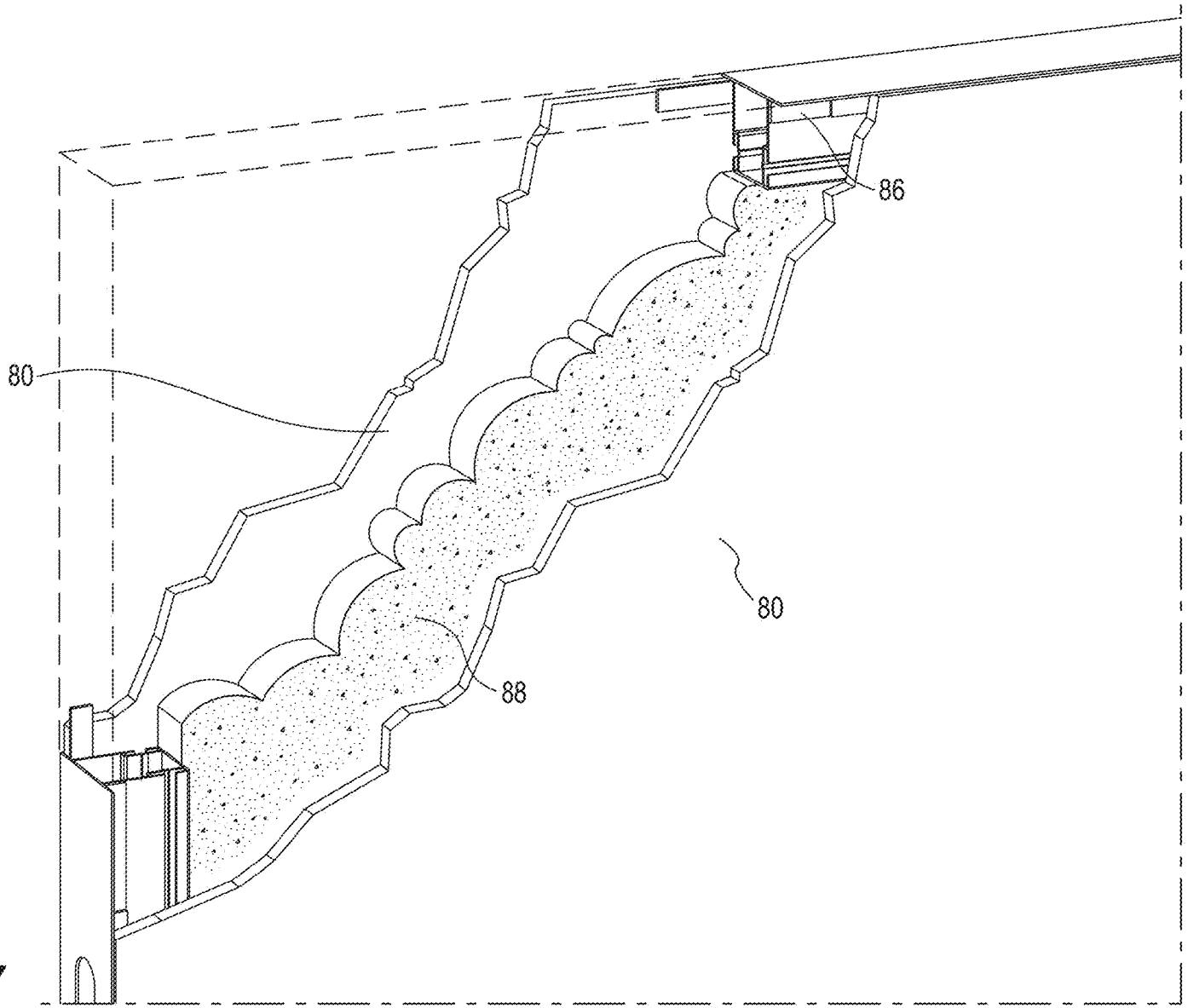
FIG. 7 shows a cut-away, cross-sectional view of the materials that are used with a frame that has been constructed from cut-to-length and attached pieces of the present invention.

For example, a rigid material such as a flat, rectangular board having interior and exterior surfaces which are connected by edges whose width defines the thickness of the board. See FIG. 7. The width of the flanges of the present invention are set so as to, when an edge-proximate portion of a board's interior surface is temporarily attached to a member side and the board's edge adjoins the flange's boundary surface, cover the board's edge by the flange's boundary surface.

These rigid materials are used as interior and exterior skin materials since they are durable and attractive. The density of this material allows for adequate sound deadening or insulation. This rigid panel also allows for mounting things (e.g., cabinets, monitors, shelving, etc.) and whatever is needed. The panels are held in place on the inside and outside of the fame with VHB Velcro 86 so that these panels can be removed for structure disassembly and reconfiguration, etc. The void in the center of the frame can be filled with additional sound insulating materials 88 to increase the sound deadening abilities of these usually semi-permanent and relocatable structures.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is set forth in the herein claims to the invention.

I claim:

1. A building element for a semi-permanent and relocatable structure, said building element comprising:

a member having a uniform, rectangular, cross-sectional shape that includes an interior portion that has a top, a bottom, two sides and four corners formed by the intersection of said sides with said top and bottom, and said member also having distal and proximal mitered, open ends and a member centerline therebetween, a pair of flanges, one of which extends outwardly from each of said two corners formed by the intersection of said sides with said top, and with each of said flanges having a boundary surface that is parallel to said top, a pair of cavities, with each having a cavity sidewall and a pair of cavity end entries, one of which is located at each of said member open ends, and with said cavities being located in said member interior portion, an opening in each of said sidewalls that extends between said member ends and has an opening centerline, and configured to provide access to said cavity, and with each said opening centerline being aligned parallel to said member centerline, and a 90-degree, flat, mitered bracket having two legs, each of which has a free end that is configured to slip fit into the cavity end entry of each of two members that are to be joined at their mitered, open ends at a right angle.

2. The building element recited in claim 1, wherein:

said mitered, open end of said member includes a cornering portion proximate each of said open ends that is tapered inward at a 45-degree angle from a point where said side attaches to said top and configured to provide said member with a mitered joint at each said open end that enables one of said members to be attached to another said member so that their member centerlines meet to form a right angle.

3. The building element recited in claim 1, further comprising:

wherein each of said mitered bracket legs having a bracket hole that passes through said leg, a fastener having a free end that is configured to pass through said opening of said member side and also through said bracket hole and to extend to said cavity sidewall and temporarily lock said bracket to said member.

4. The building element recited in claim 2, further comprising:

wherein each of said mitered bracket legs having a bracket hole that passes through said leg, a fastener having a free end that is configured to pass through said opening of said member side and also through said bracket hole and to extend to said cavity side and temporarily lock said bracket to said member.

5. The building element recited in claim 3, further comprising:

a detent formed in said cavity sidewall of each of said pair of member cavities and configured to provide a temporary locking mechanism for said free end of said fastener that extends through said opening of said member side and through said bracket hole and comes into contact with said detent.

6. The building element recited in claim 4, further comprising:

a detent formed in said cavity sidewall of each of said pair of member cavities and configured to provide a temporary locking mechanism for said free end of said fastener that extends through said opening of said member side and through said bracket hole and comes into contact with said detent.

7. The building element recited in claim 3, further comprising:

a connector hole that extends between said member top and bottom and through said interior portion, a connector configured to pass through said connectors holes, of two members which are situated so as to have their tops adjoining, to temporarily lock said members together.

8. The building element recited in claim 4, further comprising:

a connector hole that extends between said member top and bottom and through said interior portion, a connector configured to pass through said connectors holes, of two members which are situated so as to have their tops adjoining, to temporarily lock said members together.

9. The building element recited in claim 5, further comprising:

a connector hole that extends between said member top and bottom and through said interior portion, a connector configured to pass through said connectors holes, of two members which are situated so as to have their tops adjoining, to temporarily lock said members together.

10. The building element recited in claim 6, further comprising:

a connector hole that extends between said member top and bottom and through said interior portion, a connector configured to pass through said connectors holes, of two members which are situated so as to have their tops adjoining, to temporarily lock said members together.

11. The building element recited in claim 1, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

12. The building element recited in claim 2, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

13. The building element recited in claim 3, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange 17 boundary surface, covers said board edge.

14. The building element recited in claim 4, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

15. The building element recited in claim 5, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange 9 boundary surface, covers said board edge.

16. The building element recited in claim 6, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

17. The building element recited in claim 7, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

18. The building element recited in claim 8, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

19. The building element recited in claim 9, further comprising:

a flat, rectangular, rigid board having an interior surface and an exterior surface which are connected by a board edge whose width defines a thickness for said board, wherein each of said flange boundary surfaces having a free end, and wherein the distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

20. The building element recited in claim 10, further comprising:

a flat, rectangular, rigid board having an interior surface and an exterior surface which are connected by a board edge whose width defines a thickness for said board, wherein each of said flange boundary surfaces having a free end, and wherein a distance between said top corner and said free end defines the width of said flange, wherein said width of said flange is set so that said flange boundary surface, when an edge-proximate, portion of said board interior surface is temporarily attached to said member side and with said board edge proximate said flange boundary surface, covers said board edge.

* * * * *